United States Patent [19]

Saitou et al.

[11] Patent Number: 5,046,871

[45] Date of Patent: Sep. 10, 1991

[54] ACTUATOR FOR PRINT HAMMER

[75] Inventors: Seiichi Saitou; Masao Miyasaka; Nobuhiko Itoh, all of Ibaraki, Japan

[73] Assignee: Hitachi Koki Co., Ltd., Tokyo, Japan

[21] Appl. No.: 356,148

[22] Filed: May 24, 1989

[30] Foreign Application Priority Data

May 27, 1988 [JP] Japan ..... 63-70729[U]

[51] Int. Cl.[5] ..... B41J 2/27

[52] U.S. Cl. ..... 400/124; 400/157.2; 101/93.05

[58] Field of Search ..... 101/93.29, 93.30, 93.31, 101/93.32, 93.33, 93.34, 93.48; 400/124, 154.2; 335/281; 336/219

[56] References Cited

U.S. PATENT DOCUMENTS

| | | | |
|---|---|---|---|
| 2,725,502 | 11/1955 | Chiles et al. | 336/219 |
| 4,085,347 | 4/1978 | Lichius | 336/219 |
| 4,121,518 | 10/1978 | Prior et al. | 101/93.33 |
| 4,382,701 | 5/1983 | Davenport | 400/124 |
| 4,568,207 | 2/1986 | Hara et al. | 400/124 |
| 4,594,010 | 6/1986 | Jachno | 400/124 |
| 4,840,501 | 6/1989 | Wong et al. | 400/124 |

*Primary Examiner*—Edgar S. Burr
*Assistant Examiner*—Joseph R. Keating
*Attorney, Agent, or Firm*—Sughrue, Mion, Zinn Macpeak & Seas

[57] ABSTRACT

An actuator for actuating a print hammner includes a yoke made of a magnetic material, an electromagnetic coil mounted on the yoke, and an armature rotatably supported by bearings mounted on opposite sides of the yoke. Upon excitation of the electromagnetic coil, the armature is attracted to the yoke to drive the print hammer through a push rod. The yoke includes a plurality of laminated sheets of a magnetic material formed by stamping using a press. An insulating material and an adhesive are coated on the sheets.

11 Claims, 2 Drawing Sheets

ACTUATOR FOR PRINT HAMMER

BACKGROUND OF THE INVENTION

The present invention relates to an actuator for a print hammer in an impact-type line printer.

A printing mechanism for a high-speed line printer is composed of plural actuators. Each actuator is composed of a yoke, an electromagnetic coil mounted on the yoke, an armature which is attracted to the yoke each time the electromagnetic coil is excited, and a screw for defining the fixed stationary position of the armature. The armature is rotatably supported by bearings mounted on inner surfaces of respective opposed plates secured to opposite sides of the yoke. The kinetic energy of the armature is transmitted to a print hammer through a pushrod slidably mounted on a guide plate so that the print hammer presses the paper sheet against a printing character member through an ink ribbon to thereby print a character on the sheet. After printing, the print hammer is returned to its initial position by a plunger and a return spring. The actuators are mounted on a mounting base.

In order to achieve a high quality printing with the above construction, it is necessary for the print hammer to move at a speed of 5 to 5.5 m/sec. Generally, the yoke is made of a highly permeable magnetic material having excellent magnetic properties, such as 3% silicon steel. The magnetic material is shaped into the desired configuration by pressing, sintering, a lost wax process or the like. However, since the processability of such types of material is not satisfactory, it is essential that the material be subjected to a machining finishing process to obtain the required dimensional accuracy. Another problem is that the cost of such material is high, which increases the overall manufacturing cost. Further, when the armature is attracted by the electromagnetic coil and is brought into striking engagement with the yoke, the yoke is subjected to an impact force of about 5 to 10 kg. The resulting vibration is transmitted via the mounting base to the adjoining actuator, displacing the armature from its original fixed position. This results in errors such as misalignment of the printed characters.

SUMMARY OF THE INVENTION

It is therefore an object of the invention to provide an actuator which overcomes the above deficiencies of the prior art, which is less costly, and in which the armatures are capable of repeatedly operating at a high speed without being displaced from their predetermined stationary positions, thereby improving the printing quality.

According to the present invention, there is provided an actuator for a print hammer comprising a yoke made of a magnetic material, an electromagnetic coil mounted on the yoke, and an armature rotatably supported by bearings mounted on opposite sides of the yoke, the yoke comprising a plurality of laminated sheets of press-stamped magnetic material, an insulating material, and an adhesive coated on the sheets.

With this laminated construction of the yoke, eddy current losses in the magnetic circuit are reduced, thereby improving the magnetic efficiency (i.e., the force for attracting the armature).

DESCRIPTION OF THE PREFERRED EMBODIMENTS

Figure 1:
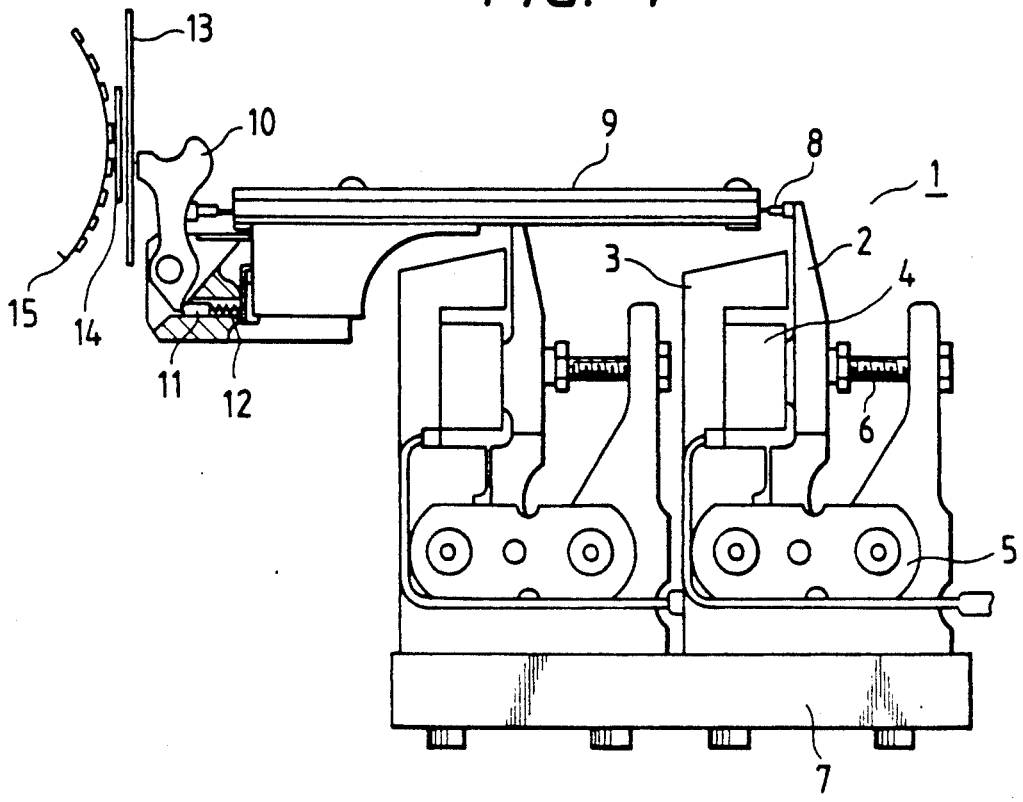
FIG. 1 is a side elevational view of a printing mechanism of a high-speed line printer incorporating print hammer actuators constructed in accordance with the present invention.
Figure 2:
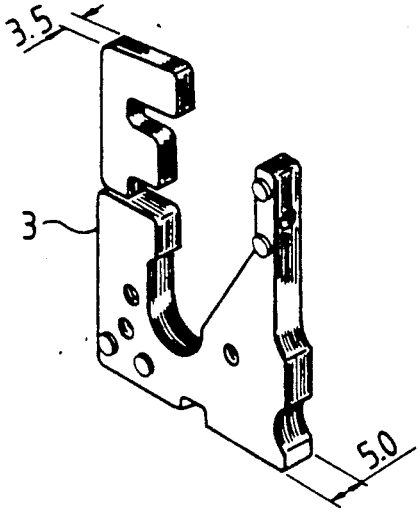
FIG. 2 is a perspective view of a yoke of the actuator.

FIG. 1 shows a printing mechanism for a high-speed line printer composed of a plurality of actuators 1. Each actuator 1 includes a yoke 3, an electromagnetic coil 4 mounted on the yoke 3, an armature 2 which is attracted to the yoke 3 each time the electromagnetic coil 4 is excited, and a screw 6 for defining the fixed stationary position of the armature 2. The armature 2 is rotatably supported by bearings (not shown) mounted on inner surfaces of respective opposed plates 5 fixedly secured to opposite sides of the yoke 3.

The kinetic energy of the armature 2 is transmitted to a print hammer 10 through a pushrod 8 slidably mounted on a guide plate 9 so that the print hammer 10 presses a paper sheet 13 against a printing character member 15 through an inked ribbon 14 to thereby print a character on the sheet 13. After printing, the print hammer 10 is returned to its initial position by a plunger 11 and a return spring 12. The actuators 1 are mounted on a mounting base 7. Although not shown in the drawings, the plurality of actuators 1 are arranged in two stages (upper and lower stages) and in two rows (front and rear rows). In order for the yokes 3 to be mounted in such a manner that they correspond to the print hammers 10 arranged at a pitch of 2.54 mm (0.1 inch), the dimension of that portion of the yoke 3 on which the electromagnetic coil 4 is mounted is limited to 3.5 mm, and the dimension of a mounting portion of the yoke 3 is limited to 5.0 mm.

The yoke 3 contains seven sheets laminated together, each sheet having a thickness of 0.5 mm, and two sheets of a thickness of 0.7 mm laminated on the opposite sides of the seven laminated sheets. Alternatively, the yoke 3 may contain seven sheets of a thickness of 0.7 mm laminated together.

With such a construction, the printing energy is improved 7 to 10% as compared with a conventional construction. Therefore, the yoke 3, which can be formed from laminated sheets made of pure iron instead of 3% silicon steel, can achieve the same printing energy as the conventional yoke. The yoke sheets can be formed, for example, by stamping using a press.

An insulating material and an adhesive are coated onto the yoke sheets to completely insulate the yoke sheets from one another to reduce the amount of eddy current loss, thereby improving the efficiency of the actuator. The thickness of the insulating material and the adhesive is several tens of microns. The insulating material is used to reinforce those portions of the yoke sheets which are susceptible to damage during a shaping operation (such as a pressing operation) or to separation during a stamping operation so as to achieve a complete insulating effect.

The adhesive is applied to the yoke sheets to form a layer of adhesive between each of the adjacent yoke sheets to thereby increase the bonding strength between the yoke sheets. The layers of the adhesive also serve to attenuate the vibration resulting from the impact produced when the armature 2 strikes the yoke 3.

The yoke sheets are bonded together by pressing using half-piercing, rivets, an adhesive, welding using an electron beam or an optical beam, or the like. The bonding strength of the yoke sheets should be such that the bonding of the yoke sheets is not affected by the impact force of the armature 2 or the tightening force exerted on the bonded yoke sheets when mounting the actuator 1 on the mounting base 7.

The insulating material and the adhesive, which are coated onto the yoke sheets, increase the bonding strength of the yoke sheets and also serve to attenuate the vibration resulting from the impact produced when the armature 2 strikes the yoke 3, thereby preventing such impact vibration from being transmitted to the adjoining actuator 1 via the mounting base 7. The yoke sheets can be readily formed or shaped by pressing, and a satisfactory dimensional accuracy thereof can be achieved by controlling only the precision of the pressing operation. Therefore, about 80% of the machining required for the conventional product can be saved or eliminated, which greatly reduces the manufacturing cost.

Figure 3:
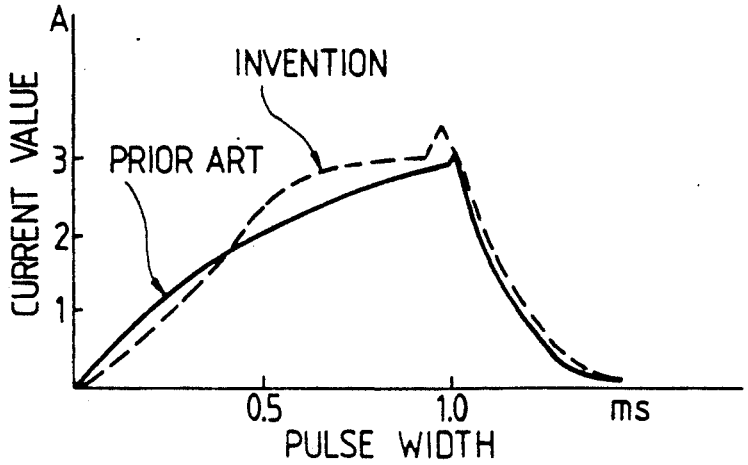
FIG. 3 is a graph showing a waveform of a current flowing through an electromagnetic coil.
Figure 4:
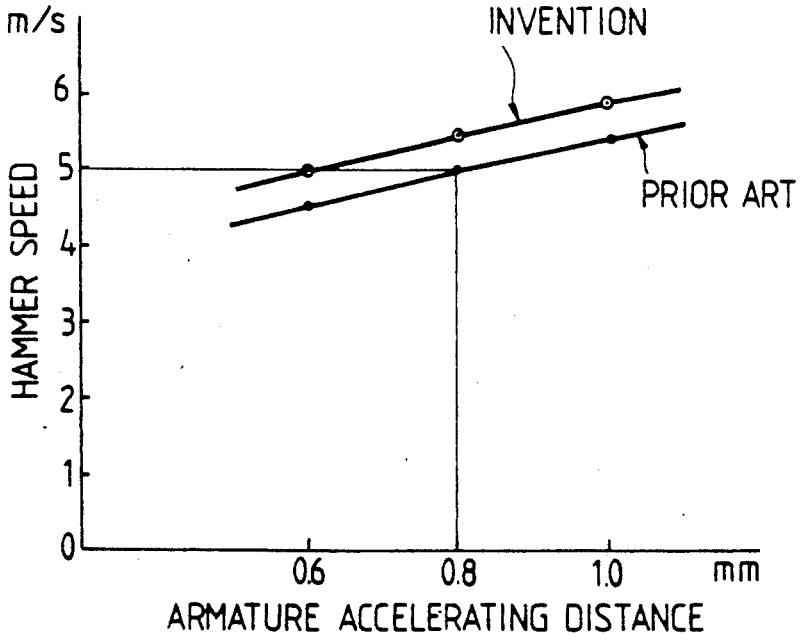
FIG. 4 is a graph showing the speed of a print hammer.

FIG. 3 is a graph showing a waveform of a current flowing through the electromagnetic coil 4. FIG. 4 is a graph showing the speed of the print hammer 10. As shown in FIG. 3, the rising characteristics of the current are improved, and it can also be appreciated that the accelerating characteristics of the armature 2 are enhanced. Also, as shown in FIG. 4, the magnetic characteristics are improved by about 7% as compared with the conventional actuator.

As described above, in accordance with the present invention, since the yoke 3 is formed with laminated yoke sheets on which insulating material and an adhesive are coated, the vibration which results from the impact produced when the armature 2 strikes the yoke 3 is attenuated, thus restraining mechanical interference with the adjoining actuator and thereby preventing misalignment of the printed characters. Further, because of the laminated construction of the yoke, the eddy current loss is reduced, and therefore the yoke 3 can be made of a magnetic material which is less costly and easier to machine, such as pure iron. Therefore, the material cost of the actuator of the invention can be reduced about 20% as compared with the conventional product. Further, the yoke sheets can be readily formed or shaped by pressing, and a satisfactory dimensional accuracy thereof can be achieved by controlling only the precision of such pressing. Therefore, about 80% of the machining required for the conventional product can be saved or eliminated, and the manufacturing cost is about half that of the conventional product.

What is claimed is:

1. An actuator for actuating a print hammer, comprising: a yoke made of a magnetic material; and electromagnetic coil mounted on said yoke; and an armature rotatably supported on said yoke comprising a plurality of laminated sheets of a press-stamped magnetic material bonded together with one another, and an insulating material and adhesive means for attenuating vibrations resulting from an impact produced when said armature strikes said yoke such that said vibrations are not transmitted to an adjoining actuator, said adhesive means being coated on abutting surfaces of said sheets.

2. The print hammer actuator of claim 1, wherein said sheets are made of iron.

3. The print hammer actuator of claim 1, wherein said yoke comprises seven sheets of a thickness of approximately 0.5 mm covered with two sheets of a thickness of approximately 0.7 mm.

4. The print hammer actuator of claim 1, wherein said yoke comprises even sheets of a thickness of approximately 0.7 mm.

5. The print hammer actuator of claim 1, wherein said sheets are bonded together by one of half-piercing, riveting, an adhesive, and welding.

6. The print hammer actuator of claim 1, wherein a thickness of said insulation material and adhesive is several tens of microns.

7. An actuator for actuating a print hammer and for use in arrangements where a plurality of actuators are provided in adjoining relationship, said actuator comprising: a yoke made of a magnetic material; and electromagnetic coil mounted on said yoke; and an armature rotatably supported on said yoke comprising a plurality of laminated sheets of a press-stamped magnetic material securely fastened together into a unitary yoke structure using securing means, and an insulating material and adhesive means for attenuating vibrations resulting from an impact produced when said armature strikes said yoke such that said vibrations are not transmitted to an adjoining actuator, said adhesive means being coated on abutting surfaces of said sheets.

8. An actuator for actuating a print hammer, comprising: a yoke made of a magnetic material; an electromagnetic coil mounted on said yoke; and an armature rotatably supported on said yoke comprising a plurality of laminated sheets of a press-stamped magnetic material bonded together with one another, and an insulating material and adhesive means for attenuating vibrations resulting from an impact produced when said armature strikes said yoke such that said vibrations are not transmitted to an adjoining actuator, said adhesive means being coated on abutting surfaces of said sheets, wherein a portion of said yoke which is used to mount said yoke is substantially 5.0 mm and a portion of said yoke on which said electromagnetic coil is mounted is substantially 3.5 mm.

9. An actuator arrangement containing actuators as claimed in claim 8, wherein a plurality of actuators are provided in adjoining relationship, with each actuator of said plurality of actuators having a print hammer in association therewith, and adjoining print hammers being provided at a pitch of substantially 2.54 mm.

10. An actuator for actuating a print hammer and for use in arrangements where a plurality of actuators are provided in adjoining relationship, said actuator comprising: a yoke made of a magnetic material; an electromagnetic coil mounted on said yoke; and an armature rotatably supported on said yoke comprising a plurality of laminated sheets of a press-stamped magnetic material securely fastened together into a unitary yoke structure using securing means, and an insulating material and adhesive means for attenuating vibrations resulting from an impact produced when said armature strikes said yoke such that said vibrations are not transmitted to an adjoining actuator, said adhesive means being coated on abutting surfaces of said sheets, wherein a portion of said yoke which is used to mount said yoke is substantially 5.0 mm and a portion of said yoke on which said electromagnetic coil is mounted is substantially 3.5 mm.

11. An actuator arrangement containing actuators as claimed in claim 10, wherein a plurality of actuators are provided in adjoining relationship, with each actuator of said plurality of actuators having a print hammer in association therewith, and adjoining print hammers being provided at a pitch of substantially 2.54 mm.

* * * * *